US005357648A

United States Patent [19]

Noestheden

[11] Patent Number: 5,357,648

[45] Date of Patent: Oct. 25, 1994

[54] PART WASHING AND DRYING MACHINE

[75] Inventor: Andrew Noestheden, Tecumseh, Canada

[73] Assignee: Valiant Machine & Tool, Inc., Windsor, Canada

[21] Appl. No.: 46,457

[22] Filed: Apr. 16, 1993

[51] Int. Cl.[5] ..... B08B 3/02

[52] U.S. Cl. ..... 15/302; 134/68; 134/72; 134/127; 134/131

[58] Field of Search ..... 15/302; 134/68, 72, 134/95.2, 127, 131; 198/456

[56] References Cited

U.S. PATENT DOCUMENTS

| | | | |
|---|---|---|---|
| 1,569,191 | 1/1926 | Lathrop et al. | 134/68 |
| 1,676,714 | 7/1928 | Smallidge | 134/68 X |
| 2,966,914 | 1/1961 | Sadwith | 134/68 |
| 3,596,747 | 8/1971 | Irving, Jr. et al. | 198/456 X |
| 3,785,387 | 1/1974 | Ross | 134/95.2 |
| 3,958,586 | 5/1976 | Schnelle | 134/127 X |

FOREIGN PATENT DOCUMENTS

| | | | |
|---|---|---|---|
| 3235336 | 3/1984 | Fed. Rep. of Germany | 198/456 |
| 184137 | 4/1923 | United Kingdom | 134/72 |

*Primary Examiner*—Philip R. Coe
*Attorney, Agent, or Firm*—Gifford, Groh, Sprinkle, Patmore and Anderson

[57] ABSTRACT

An apparatus is disclosed for washing and then drying industrial parts. The apparatus includes a housing having an inlet for receiving the parts to be washed and an outlet for discharging the parts after drying. A first conveyor has one end positioned adjacent the housing inlet for receiving the incoming parts to be washed, and a second conveyor having one end adjacent the housing outlet. The conveyors are preferably positioned in a side by side relationship and are constructed from an endless chain. A motor drives the first and second conveyors. A liquid sprayer has a plurality of outlet nozzles positioned above the first conveyor so that liquid washing fluid is directed against parts on the first conveyor. A transfer rail transfers the parts from the first conveyor to the second conveyor after washing and an air blower having a plurality of air outlet nozzles are directed towards the parts on the second conveyor to thereby dry the parts prior to their discharge from the housing outlet.

6 Claims, 3 Drawing Sheets

PART WASHING AND DRYING MACHINE

BACKGROUND OF THE INVENTION

I. Field of the Invention

The present invention relates generally to an apparatus for washing and then drying industrial parts.

II. Description Of the Prior Art

In industrial applications where parts are manufactured, machined or the like, it is necessary to wash the pans prior to their final assembly. Such washing removes metal shavings, cutting oil and the like which may be present on the pan and which must be removed prior to final assembly.

The previously known part washing and drying machines typically comprise an elongated endless conveyor which transports the parts from an inlet end to an outlet end. A washing solution is directed onto the parts in order to remove cutting oil, shavings and other debris from the parts on the conveyor. Thereafter, an air flow is directed against the pans to dry the parts prior to their exit from the part washing and drying machine.

These previously known machines for washing and drying industrial pans were disadvantageously quite lengthy in construction in order to ensure full washing and drying of the parts prior to discharge from the machine. This disadvantageously increased not only the overall costs for the machine, but also utilized valuable floor space in the industrial facility which could otherwise be put to other purposes.

A primary reason for the long length of these previously known washer and drying machine is that the washing liquid used to wash the pans necessarily impinged upon and dampened the underlying conveyor. Thus, in order to dry the parts, it is necessary to have sufficient air flow over a sufficient length of conveyor travel to dry not only the pans on the conveyor, but also the underlying conveyor system.

SUMMARY OF THE PRESENT INVENTION

The present invention provides a machine for washing and then drying industrial parts which overcomes all of the above mentioned disadvantages of the previously known devices.

In brief, the machine of the present invention comprises a housing having an inlet for receiving parts to be washed and an outlet for discharging parts after drying. A first conveyor has one end adjacent the housing inlets for receiving the parts to be washed and, similarly, a second conveyor has one end adjacent the housing outlet for discharging the parts after drying. Preferably, the first and second conveyors each comprise an open mesh endless conveyor in a side by side relationship with respect to each other.

The machine further includes means for spraying a liquid washing solution through a plurality of nozzles which overlie a portion of the first conveyor adjacent the housing inlet. This washing fluid thus removes shavings, curing oil and the like from the parts as they pass under the nozzles.

After the parts pass under the washing nozzles, a transfer rail laterally displaces the pans to the second conveyor. A plurality of air nozzles are then directed on the parts on the second conveyor thereby drying the parts on the second conveyor prior to their discharge from the housing outlet. Preferably, a turbine air pump is used as the air pump source for high volume and high speed air flow against the parts.

A primary advantage of the present invention is that the second conveyor, i.e. the conveyor on which the parts are dried, are shielded from the liquid washing solution used to wash the parts on the first conveyor. Consequently, the second conveyor remains relatively dry. This in turn minimizes the conveyor travel time and air flow necessary to dry the parts transported by the second conveyor to the outlet end of the housing.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
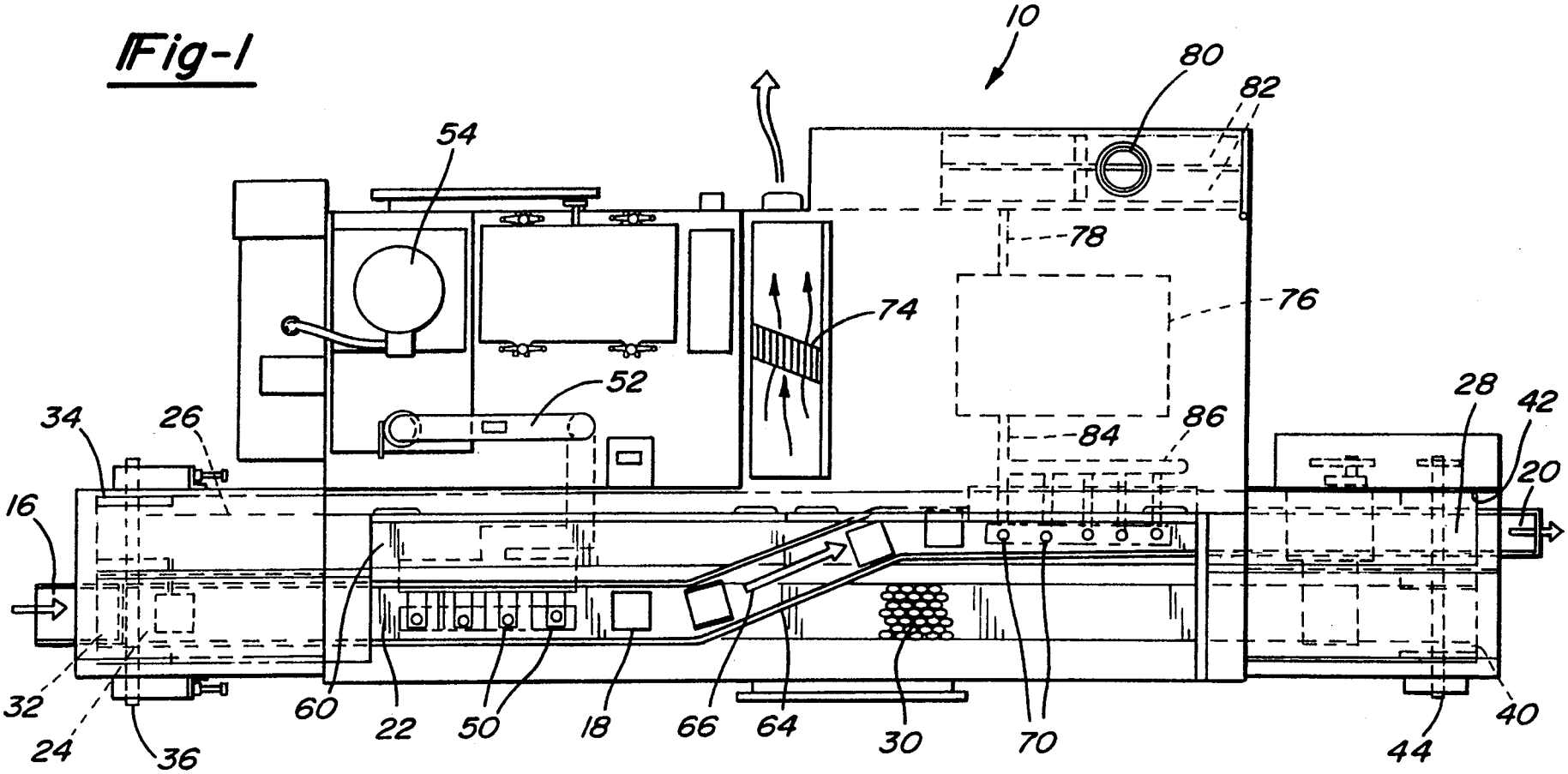
FIG. 1 is a top plan view illustrating a preferred embodiment of the present invention.
Figure 2:
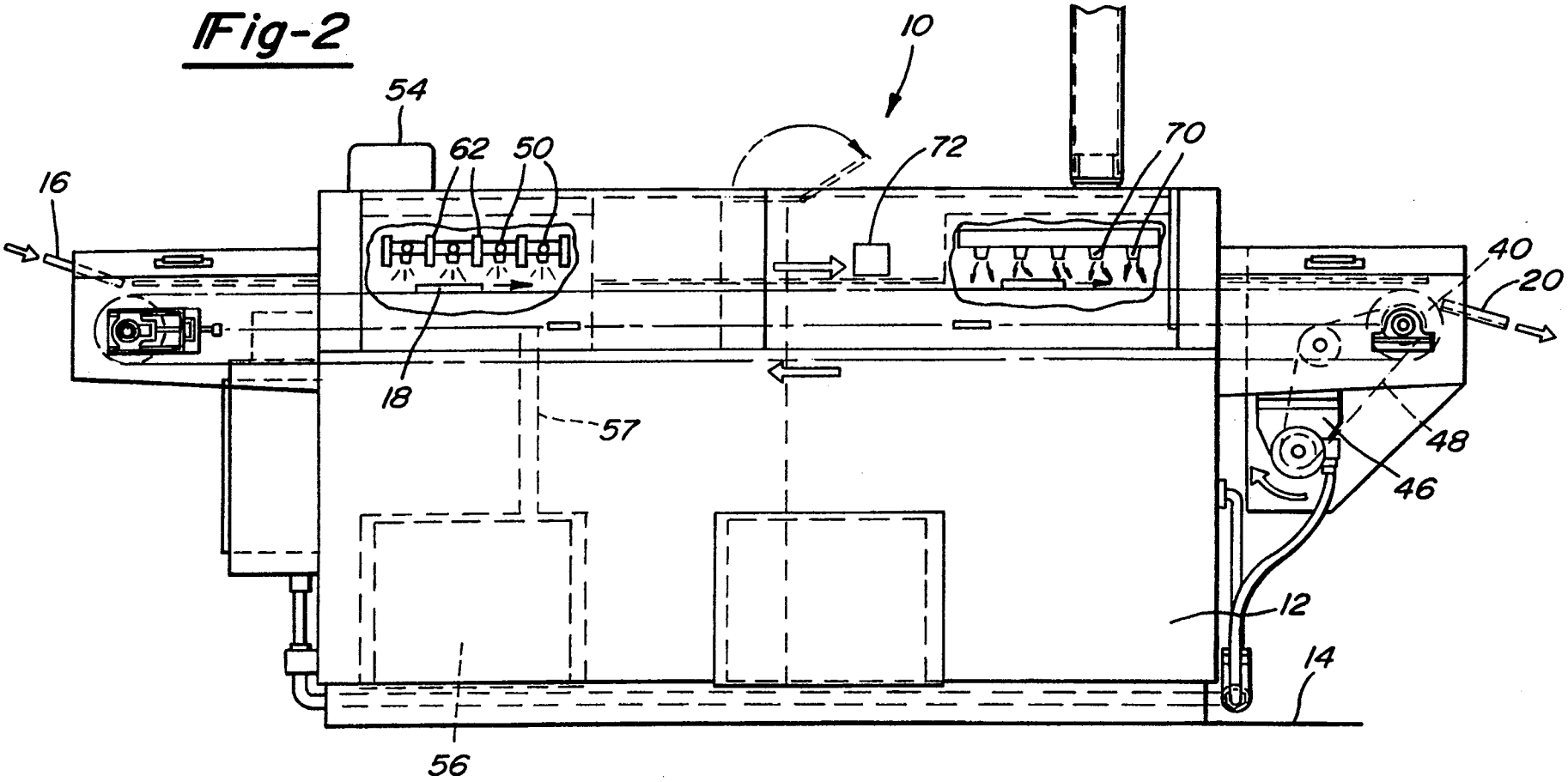
FIG. 2 is a front plan view illustrating the preferred embodiment of the invention.

With reference first to FIGS. 1 and 2, a preferred embodiment of the part washing and drying machine 10 of the present invention is thereshown and comprises a housing 12 which is supported on a ground support surface 14 (FIG. 2). The housing 12 includes a downwardly extending inlet chute 16 for receiving the parts 18 to be washed and a downwardly depending outlet chute 20 for discharging the parts 18 after they have been washed and dried.

Still referring to FIGS. 1 and 2, the machine 10 further comprises a first conveyor 22 having a first end 24 adjacent to and in alignment for receiving the parts 18 from the inlet chute 16. Similarly, a second conveyor 26 has an outlet end 28 adjacent to and in alignment with the outlet chute 24 discharging the parts 18 from the machine 10 after drying.

Both conveyors 22 and 26 are preferably endless conveyors of an open chain or open mesh construction as indicated at 30 in FIG. 1. Furthermore, both conveyors 22 and 26 are arranged in a side by side relationship best shown in FIG. 3. As such, the ends of the conveyors 22 and 26 adjacent the inlet chute 16 are mounted on coaxial sprockets 32 and 34, both of which are mounted on an axle 36. Similarly, the ends of the conveyors 22 and 26 which are adjacent the outlet chute 40 are mounted on coaxial sprockets 40 and 42 which are mounted on a common axle 44.

As best shown in FIG. 2, a motor 46 is drivingly connected to the sprockets 40 and 42 by a drive chain 48. Thus, actuation of the motor 46 rotatably drives both conveyors 22 and 24 in synchronism with each other. Although any motor 46 can be used to drive the conveyors 22 and 26, preferably the motor 46 is a hydraulic motor.

Referring again to FIGS. 1 and 2, a plurality of longitudinally spaced liquid spray nozzles 50 are disposed above the first conveyor 22 so that liquid discharge from the nozzles 50 is directed downwardly onto the parts 18 on the first conveyor 22. These nozzles 50 are connected through piping 52 and a pump 54 to a reservoir 56 (FIG. 2) of liquid washing solution. Consequently, actuation of the pump 54 directs liquid from the reservoir 56 through the piping 52 and thus outwardly through the nozzles 50 and onto the parts 18 on the first conveyor 22. Appropriate return passageways 56 (illustrated diagrammatically in FIG. 2) return the washing solution after impingement on the parts 18 to the reservoir 56 so that the washing solution is recycled. In practice, sludge accumulates at the bottom of the reservoir 56 which must be periodically removed.

In order to protect the second conveyor 26 from liquid from the nozzles 50, the housing 12 preferably includes shielding 60 (FIG. 1) which overlies the second conveyor 26 adjacent the nozzles 50. Additionally, the housing 12 preferably includes a partition wall 62 (FIG. 2) between each adjacent nozzle 50 to prevent interference from the spray of one nozzle 50 and its adjacent nozzle.

With reference now solely to FIG. 1, a transfer rail 64 extends laterally and obliquely from the first conveyor 22 over the second conveyor 26 at a position downstream from the spray nozzles 50. The transfer rail 64 is stationary with respect to the conveyors 22 and 26 and is positioned above the conveyors 22 and 26. As such, the transfer rail 64 diverts the parts 18 from the first conveyor 22 to the second conveyor 26 as indicated by arrow 66.

Referring again to FIGS. 1 and 2, a plurality of air nozzles 70 are positioned above the second conveyor 26 downstream from the transfer rail 64 so that air flow through the nozzles 70 impinges upon and dries parts 18 which have been transferred from the first conveyor 22 to the second conveyor 26 by the transfer rail 64. A passageway 72 (FIG. 2) in the housing provides an outlet for the air from the nozzles 62 This passageway 72 is fluidly connected to a water separator 74 (FIG. 1 ) which separates liquid from the air flow prior to its discharge from the housing 12.

With reference now to FIGS. I and 3, a turbine blower 76, illustrated diagrammatically, is provided to create the air flow through the air nozzles 70. This blower 76 has its inlet 78 connected to an intake stack 80 through air filters 82, and its outlet 84 connected to a manifold 86 (FIG. 1 ) open to the air nozzles 70. Thus, actuation of the pump 76 inducts air through the stack 80 and filter elements 82 and discharges the inducted air out through the air nozzles 70 and onto the parts 18 on the second conveyor 26.

Figure 3:
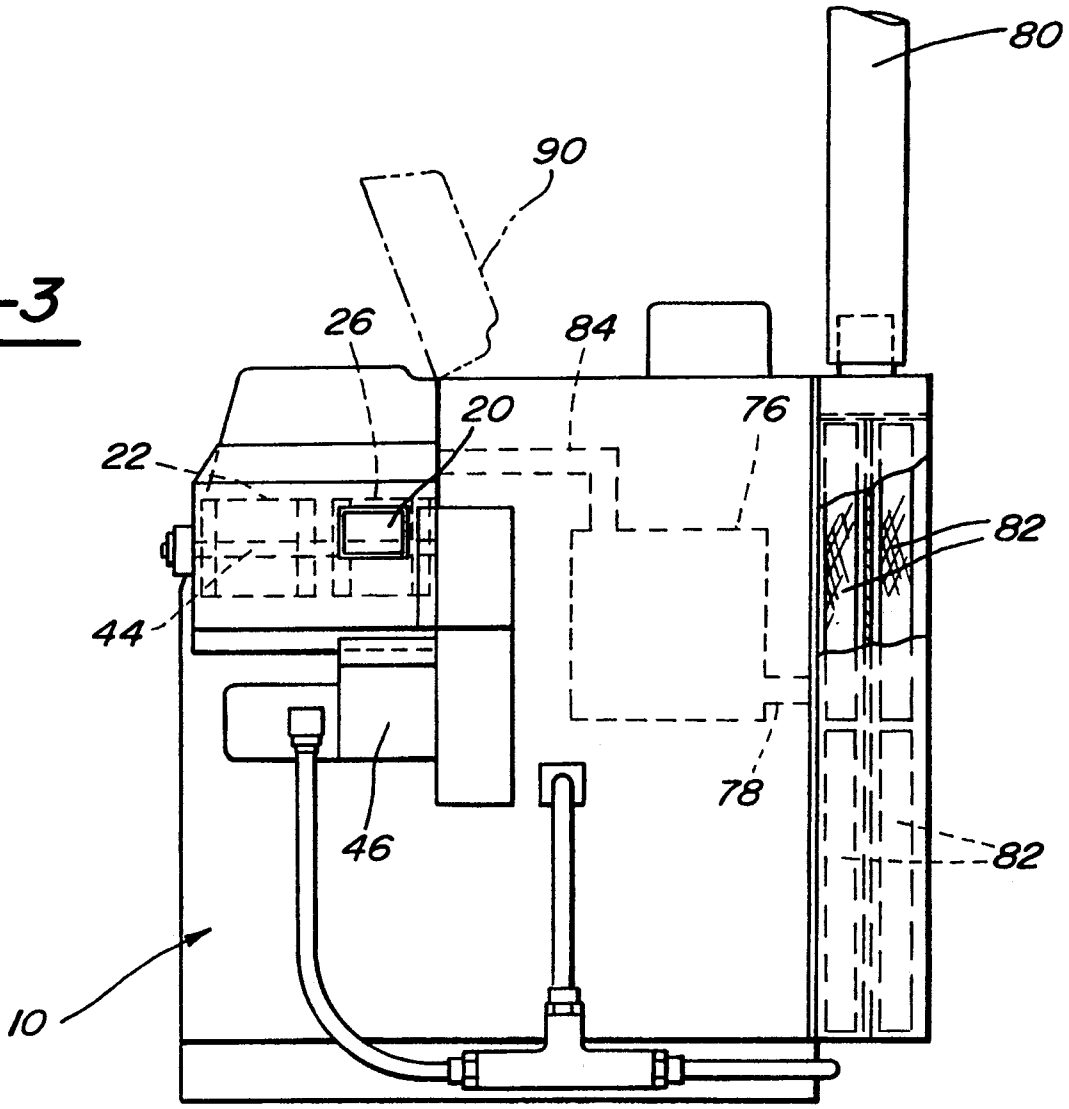
FIG. 3 is an end plan view illustrating the preferred embodiment of the present invention.

As best shown in FIG. 3, the housing 10 includes at least one and preferably two covers 90 which selectively enclose the conveyors 22 and 24 between their inlet end 24 and outlet end 28 These lids 90 not only confine the air flow and liquid flow to the housing 10, but also preferably contain soundproofing to minimize the sound generation from the washing and drying machine 10. Furthermore, the partition walls 62 (FIG. 2) provided between the adjacent liquid spray nozzles 50 are also preferably mounted to the lid 90.

In operation, parts to be washed are slid down the inlet chute 16 and onto the first conveyor 22. The motor 46 then drives the conveyors 22 and 26 towards the outlet end 28 and thus moves the parts 18 underneath the liquid ,spray nozzles 50. The washing solution from the liquid spray nozzles washes the shavings, cutting oil and any other debris on the parts 18 off from the parts. The solution and its entrained debris is then returned to the reservoir 56. The motor 46 continuously drives the conveyors 22 and 26 so that the parts 18 are moved past the liquid spray nozzles and to the transfer rail 64. The transfer rail 64, coupled with the continued movement of the conveyors 22 and 26, then laterally transfers the washed parts 18 to the second conveyor 26. The second conveyor 26 then moves the washed parts 18 under the drying air nozzles 70 which dries the parts 18. By the time the parts 18 have passed past the air nozzles 70, the parts are dry and the dried parts are discharged out the outlet chute 20.

A primary advantage of Applicant's invention is that the second conveyor 26 is maintained substantially dry since it is shielded from the spray nozzles 50. Thus, the air flow from the drying nozzles 70 is only required to dry the dampened parts 18 rather than the parts 18 and the underlying conveyor. Furthermore, the turbine air pump 76 provides a high volume air flow through the nozzles 70 which further facilitates drying of the parts 18.

From the foregoing, it can be seen that the present invention provides a machine for washing and drying industrial parts which is simple and compact in construction, and yet highly effective in use. Having described my invention, however, many modifications thereto will become apparent to those skilled in the art to which it pertains without deviation from the spirit of the invention as defined by the scope of the appended claims.

I claim:

1. Apparatus for washing and then drying parts comprising:

a housing having an inlet for receiving parts to be washed and an outlet for discharging parts after drying, a first conveyor having one end adjacent said housing inlet for receiving parts to be washed, a second conveyor having one end adjacent said housing outlet;

means for driving said first and second conveyors, means for spraying a liquid washing solution on said parts on said first conveyor, means for transferring said parts from said first conveyor to said second conveyor after said liquid spraying means, means for directing a gas stream onto said parts on said second conveyor to thereby dry said parts, wherein said first and second conveyors each comprise an endless chain, a pair of spaced apart sprockets both of said chains being disposed around said sprockets so that said first and second conveyors are disposed in a side by side relationship and are coplanar with each other, a stationary transfer rail extending diagonally across said first and second conveyors at a mid point between said sprockets, and means for shielding said second conveyor from said liquid spraying means so that said second conveyor remains substantially dry.

2. The invention as defined in claim 1 wherein a single motor drives both of said conveyors.

3. The invention as defined in claim 1 wherein said means for directing a gas stream onto said pans comprises a turbine air pump having an air outlet, a plurality of drying nozzles directed at pans on the second conveyor and means for fluidly connecting said air outlet to said drying nozzles.

4. The invention as defined in claim 3 wherein said air pump has an air inlet and further comprising means for filtering air upstream from said air inlet.

5. The invention as defined in claim 1 wherein said spraying means comprises a liquid pump having a liquid outlet, a plurality of liquid spray nozzles directed at parts on said first conveyor and means, for fluidly connecting said pump outlet to said liquid spray nozzles.

6. The invention as defined in claim 5 and comprising a lid which selectively covers said first conveyor around said liquid spray nozzles, said lid having a partition disposed between each pair of adjacent liquid spray nozzles.

* * * * *

UNITED STATES PATENT AND TRADEMARK OFFICE

CERTIFICATE OF CORRECTION

PATENT NO. : 5,357,648

DATED : 10/25/94

INVENTOR(S) : Andrew Noestheden

It is certified that error appears in the above-indentified patent and that said Letters Patent is hereby corrected as shown below:

Column 1, line 14, "pan" should be --part--.
Column 1, line 22, "pans" should be --parts--.
Column 1, line 25, "pans" should be--parts--.

Column 1, line 34, "pans" should be --parts--.
Column 1, line 38, "pans" should be --parts--.
Column 1, line 61, "curing" should be --cutting--.
Column 1, line 64, "pans" should be --parts--.
Column 2, line 41, "24" should be --20--.
Column 2, line 51, "40" should be --20--.
Column 3, line 4, "56" should be --57--.
Column 3, line 9, "second" should be --first--.
Column 3, line 9, "26" should be --22--.
Column 3, line 33, after "62" insert --.--.
Column 3, line 48, "covers" should be --lids--.
Column 3, line 49, "24" should be --26--.
Column 3, line 50, after "28" insert --.--.
Column 3, line 61, after "liquid" delete ",".
Column 4, line 59, "pans" should be --parts--.
Column 4, line 61, "pans" should be --parts--.

UNITED STATES PATENT AND TRADEMARK OFFICE

CERTIFICATE OF CORRECTION

PATENT NO. : 5,357,648

DATED : 10/25/94

INVENTOR(S) : Andrew Noestheden

It is certified that error appears in the above-indentified patent and that said Letters Patent is hereby corrected as shown below:

Column 5, line 2, after "means" delete ",".

Signed and Sealed this

Second Day of May, 1995

Bruce Lehman

*Attest:*

BRUCE LEHMAN

*Attesting Officer*

*Commissioner of Patents and Trademarks*